US010319394B2

(12) United States Patent
Rennies et al.

(10) Patent No.: US 10,319,394 B2
(45) Date of Patent: Jun. 11, 2019

(54) APPARATUS AND METHOD FOR IMPROVING SPEECH INTELLIGIBILITY IN BACKGROUND NOISE BY AMPLIFICATION AND COMPRESSION

(71) Applicant: Fraunhofer-Gesellschaft zur Foerderung der angewandten Forschung e.V., Munich (DE)

(72) Inventors: Jan Rennies, Oldenburg (DE); Henning Schepker, Oldenburg (DE); Simon Doclo, Oldenburg (DE); Jens E. Appell, Wardenburg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/794,629

(22) Filed: Jul. 8, 2015

(65) Prior Publication Data

US 2015/0310875 A1 Oct. 29, 2015

Related U.S. Application Data

(63) Continuation of application No. PCT/EP2013/067574, filed on Aug. 23, 2013.

(Continued)

(51) Int. Cl.

*G10L 21/00* (2013.01)
*G10L 21/0364* (2013.01)
*G10L 21/0316* (2013.01)

(52) U.S. Cl.

CPC ..... *G10L 21/0364* (2013.01); *G10L 21/0316* (2013.01)

(58) Field of Classification Search

CPC ..... G10L 21/00; G10L 21/0205; G10L 21/02; G10L 21/0208; G10L 21/0216;

(Continued)

(56) References Cited

U.S. PATENT DOCUMENTS 6,810,273 B1 * 10/2004 Mattila ..... G10L 21/0208 370/286
2002/0116179 A1 * 8/2002 Watanabe ..... G10L 19/02 704/200.1

(Continued)

FOREIGN PATENT DOCUMENTS

GB 2437559 A * 10/2007 ..... G10L 21/0208
JP H04348000 A 12/1992

(Continued)

OTHER PUBLICATIONS

Sauert, Bastian, and Peter Vary. "Recursive closed-form optimization of spectral audio power allocation for near end listening enhancement." ITG-Fachbericht-Sprachkommunikation 2010 (2010).*

(Continued)

*Primary Examiner* — Paras D Shah
(74) *Attorney, Agent, or Firm* — Perkins Coie LLP; Michael A. Glenn

(57) ABSTRACT

An apparatus for generating a modified speech signal from a speech input signal which has a plurality of speech subband signals, the modified speech signal having a plurality of modified subband signals is provided, having: a weighting information generator for generating weighting information for each speech subband signal depending on a signal power of said speech subband signal, and a signal modifier for modifying each speech subband signal by applying the weighting information on said speech subband signal to obtain a modified subband signal. The weighting information generator is configured to generate the weighting information for each of the plurality of speech subband (Continued)

signals, wherein the signal modifier is configured to modify each of the speech subband signals so that a first speech subband signal having a first signal power is amplified with a first degree, and so that a second speech subband signal having a second signal power is amplified with a second degree, the first signal power being greater than the second signal power, and the first degree being lower than the second degree.

20 Claims, 11 Drawing Sheets

Related U.S. Application Data

(60) Provisional application No. 61/750,228, filed on Jan. 8, 2013.

(58) Field of Classification Search
CPC ..... G10L 21/0224; G10L 21/0232; G10L 21/0316; G10L 21/0364; G10L 21/034
USPC ..... 704/226, 227, 228, 233
See application file for complete search history.

(56) References Cited

U.S. PATENT DOCUMENTS

2005/0240401 A1* 10/2005 Ebenezer ..... G10L 21/0208 704/226
2005/0244023 A1* 11/2005 Roeck ..... H04R 25/453 381/321
2006/0270467 A1* 11/2006 Song ..... G10L 21/0208 455/570
2007/0223716 A1* 9/2007 Shirakawa ..... G10L 19/26 381/73.1
2008/0075300 A1* 3/2008 Isaka ..... G10L 21/0208 381/94.2
2008/0189104 A1* 8/2008 Zong ..... G10L 21/02 704/226
2008/0219472 A1* 9/2008 Chhatwal ..... G10L 21/0208 381/94.3
2009/0067644 A1* 3/2009 Crockett ..... H04S 7/00 381/98
2009/0299742 A1* 12/2009 Toman ..... G10L 21/0272 704/233
2010/0121632 A1* 5/2010 Chong ..... G10L 19/008 704/200.1
2010/0121634 A1* 5/2010 Muesch ..... G10L 21/0205 704/224
2010/0211382 A1* 8/2010 Sugiyama ..... H04B 3/23 704/205
2011/0112843 A1* 5/2011 Shimada ..... G10L 21/0272 704/500
2011/0142256 A1* 6/2011 Lee ..... G10L 21/0208 381/94.3
2012/0026345 A1* 2/2012 Osako ..... G10L 21/0208 348/207.99
2012/0057711 A1* 3/2012 Makino ..... G10L 21/0208 381/57
2013/0188799 A1* 7/2013 Otani ..... H04B 3/20 381/66
2013/0297306 A1* 11/2013 Hetherington ..... G10L 19/09 704/233

FOREIGN PATENT DOCUMENTS

JP H11298990 A 10/1999
JP 2010068175 A 3/2010
JP 2010519601 A 6/2010
WO 2011048813 A1 4/2011

OTHER PUBLICATIONS

Sauert, Bastian, and Peter Vary. "Near-end listening enhancement in the presence of bandpass noises." Speech Communication; 10. ITG Symposium; Proceedings of. VDE, 2012.*
Arslan, et al., "New methods for adaptive noise suppression", 1995 International Conference on Acoustics, Speech, and Signal Processing—Detroit, MI, USA. IEEE, vol. 1 XP010625357. May 9-12, 1995, pp. 812-815.
Arslan, et al., "New methods for adaptive noise suppression", 1995 International Conference on Acoustics, Speech, and Signal Processing—Detroit, MI, USA. IEEE, vol. 1 ISBN: 978-0-7803-24, May 9-12, 1995, pp. 812-815.
"Methods for calculation of the speech intelligibility index", American National Standard ANSI S3.5-1997 (American National Standards Institute, Inc.), New York, USA., 1997, 31 pages.
Vaidyanathan et al., "A new approach to the realization of low-sensitivity IIR digital filters", IEEE Transactions on Acoustics, Speech and Signal Processing, vol. ASSP-34, No. 2, Apr. 1986, pp. 350-361.
Zorila et al., "Speech-in-noise intelligibility improvement based on power recovery and dynamic range compression", In 20th European Signal Processing Conference (EUSIPCO 2012), Bucharest Romania., Aug. 27-31, 2012, pp. 2075-2079.
Zorila et al., "Speech-in-noise intelligibility improvement based on spectral shaping and dynamic range compression", In Proceedings of Interspeech 2012 (Portland, USA), Sep. 9-13, 2012, pp. 635-638.

* cited by examiner

APPARATUS AND METHOD FOR IMPROVING SPEECH INTELLIGIBILITY IN BACKGROUND NOISE BY AMPLIFICATION AND COMPRESSION

CROSS-REFERENCE TO RELATED APPLICATIONS

This application is a Continuation of copending International Application No. PCT/EP2013/067574, filed Aug. 23, 2013, which claims priority from U.S. Provisional Application No. 61/750,228, filed Jan. 8, 2013, which are each incorporated herein in its entirety by the reference thereto.

BACKGROUND OF THE INVENTION

The present invention relates to audio signal processing, and, in particular, to an apparatus and a method for improving speech intelligibility in background noise by amplification and compression.

In many speech communication applications (e.g., public address systems in train stations or mobile phones) it is of great interest to maintain high speech intelligibility even in situations where speech is disturbed by additive noise and/or reverberation. One simple approach to maintain that goal is to amplify the speech signal prior to presentation in order to achieve a good signal-to-noise ratio (SNR). However, often such simple amplification is not possible due to technical limitations of the amplification system or unpleasantly high sound levels. Therefore, algorithms that improve the speech intelligibility while maintaining equal output power compared to the power observed at the input are desirable. This invention comprises an algorithm that is capable of increasing the speech intelligibility in scenarios with additive noise without increasing the overall speech level.

Other signal processing strategies that go beyond simple amplification have been presented in the literature (see [1], [2], [3], [5], [6]).

However, it would be very appreciated if improved signal processing concepts for speech communications applications would be provided.

SUMMARY

According to an embodiment, an apparatus for generating a modified speech signal from a speech input signal, wherein the speech input signal has a plurality of speech subband signals, wherein the modified speech signal has a plurality of modified subband signals, may have: a weighting information generator for generating weighting information for each speech subband signal of the plurality of speech subband signals depending on a signal power of said speech subband signal, and a signal modifier for modifying each speech subband signal of the plurality of speech subband signals by applying the weighting information of said speech subband signal on said speech subband signal to obtain a modified subband signal of the plurality of modified subband signals, wherein the weighting information generator is configured to generate the weighting information for each of the plurality of speech subband signals and wherein the signal modifier is configured to modify each of the speech subband signals so that a first speech subband signal of the plurality of speech subband signals having a first signal power is amplified with a first degree, and so that a second speech subband signal of the plurality of speech subband signals having a second signal power is amplified with a second degree, wherein the first signal power is greater than the second signal power, and wherein the first degree is lower than the second degree.

According to another embodiment, a method for generating a modified speech signal from a speech input signal, wherein the speech input signal has a plurality of speech subband signals, wherein the modified speech signal has a plurality of modified subband signals, may have the steps of: generating weighting information for each speech subband signal of the plurality of speech subband signals depending on a signal power of said speech subband signal, and modifying each speech subband signal of the plurality of speech subband signals by applying the weighting information of said speech subband signal on said speech subband signal to obtain a modified subband signal of the plurality of modified subband signals, wherein generating the weighting information for each of the plurality of speech subband signals and modifying each of the speech subband signals is conducted so that a first speech subband signal of the plurality of speech subband signals having a first signal power is amplified with a first degree, and so that a second speech subband signal of the plurality of speech subband signals having a second signal power is amplified with a second degree, wherein the first signal power is greater than the second signal power, and wherein the first degree is lower than the second degree.

Another embodiment may have a computer program for implementing the above method when being executed on a computer or signal processor.

When a first speech subband signal of the plurality of speech subband signals having a first signal power is amplified with a first degree, and when a second speech subband signal of the plurality of speech subband signals having a second signal power is amplified with a second degree, wherein the first degree is lower than the second degree, e.g., this means that the ratio of the signal power of a first modified subband signal resulting from amplifying the first speech subband signal to the signal power of the first speech subband signal is lower than the ratio of the signal power of a second modified subband signal resulting from amplifying the second speech subband signal to the signal power of the second speech subband signal.

Embodiments which employ the proposed concepts may combine a time-and-frequency-dependent gain characteristic with a time-and-frequency-dependent compression characteristic that are both a function of the estimated speech intelligibility index (SII). The gain may be used to adaptively pre-process the speech signal depending on the current noise signal such that intelligibility is maximized while the speech level is kept constant.

Depending on the technical system in which the concepts are employed, e.g., in which a corresponding algorithm is running, the concepts (e.g., the algorithm) may or may not be combined with a general volume control to additionally vary the speech level. In the following a detailed description of one possible realization of the algorithm is provided.

The exact parameters or functionality of the individual steps can be modified and anyone skilled in the art will be able to identify such modifications.

BRIEF DESCRIPTION OF THE DRAWINGS

In the following, embodiments of the present invention are described in more detail with reference to the figures, in which.

DETAILED DESCRIPTION OF THE INVENTION

Figure 1:
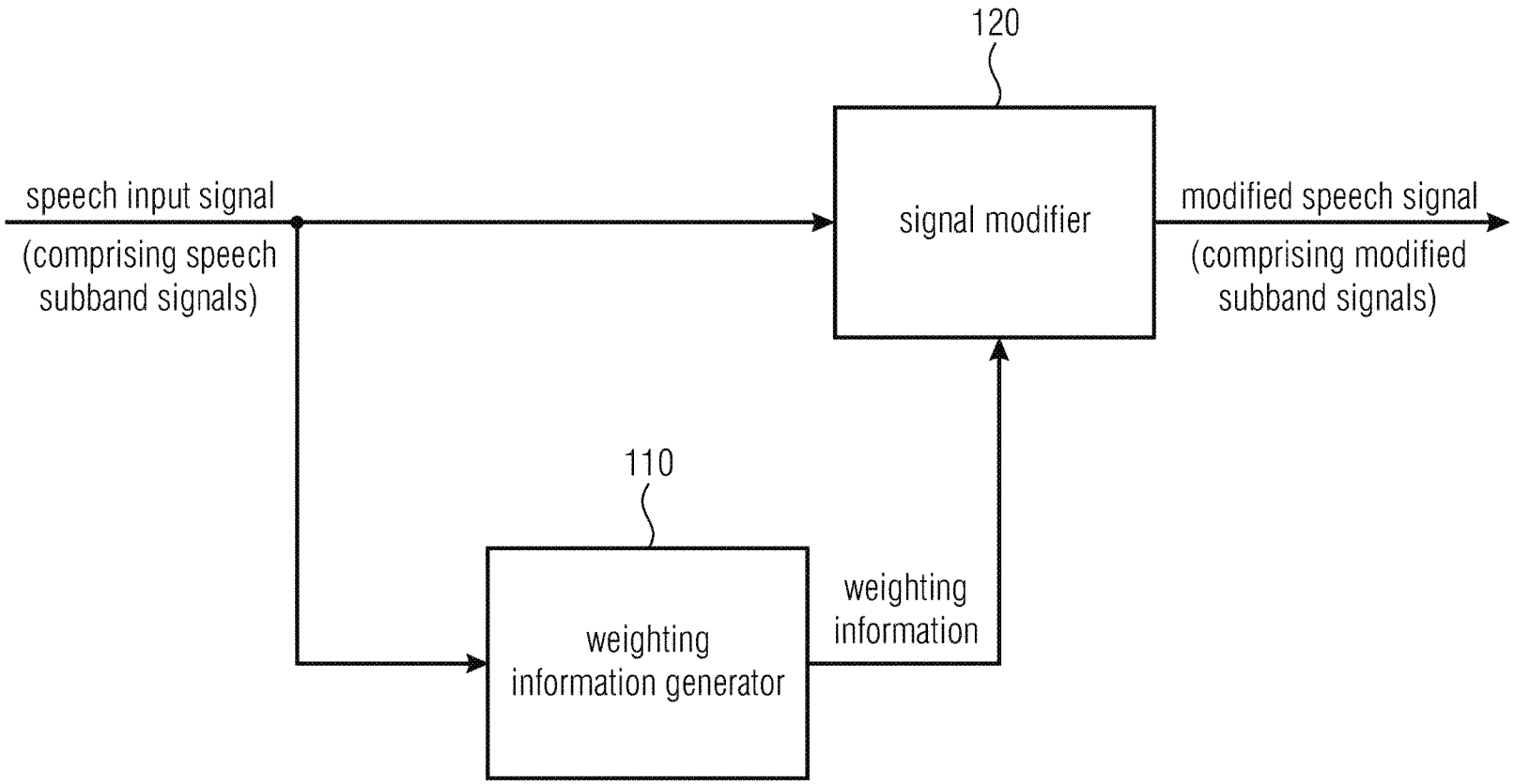
FIG. 1 illustrates an apparatus for generating a modified speech signal according to an embodiment.

FIG. 1 illustrates an apparatus for generating a modified speech signal from a speech input signal according to an embodiment. The speech input signal comprises a plurality of speech subband signals. The modified speech signal comprises a plurality of modified subband signals.

The apparatus comprises a weighting information generator 110 for generating weighting information for each speech subband signal of the plurality of speech subband signals depending on a signal power of said speech subband signal.

Moreover, the apparatus comprises a signal modifier 120 for modifying each speech subband signal of the plurality of speech subband signals by applying the weighting information of said speech subband signal on said speech subband signal to obtain a modified subband signal of the plurality of modified subband signals.

The weighting information generator 110 is configured to generate the weighting information for each of the plurality of speech subband signals and the signal modifier 120 is configured to modify each of the speech subband signals so that a first speech subband signal of the plurality of speech subband signals having a first signal power is amplified with a first degree, and so that a second speech subband signal of the plurality of speech subband signals having a second signal power is amplified with a second degree, wherein the first signal power is greater than the second signal power, and wherein the first degree is lower than the second degree.

Figure 3A:
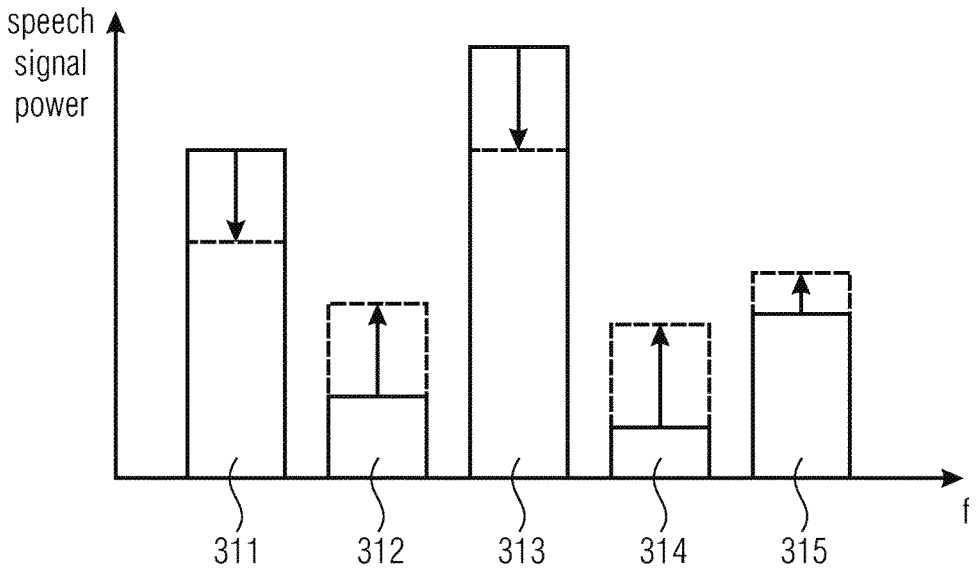
FIG. 3*a* illustrates the speech signal power of the speech subband signals before an amplification of the speech subband signals takes place.
Figure 3B:
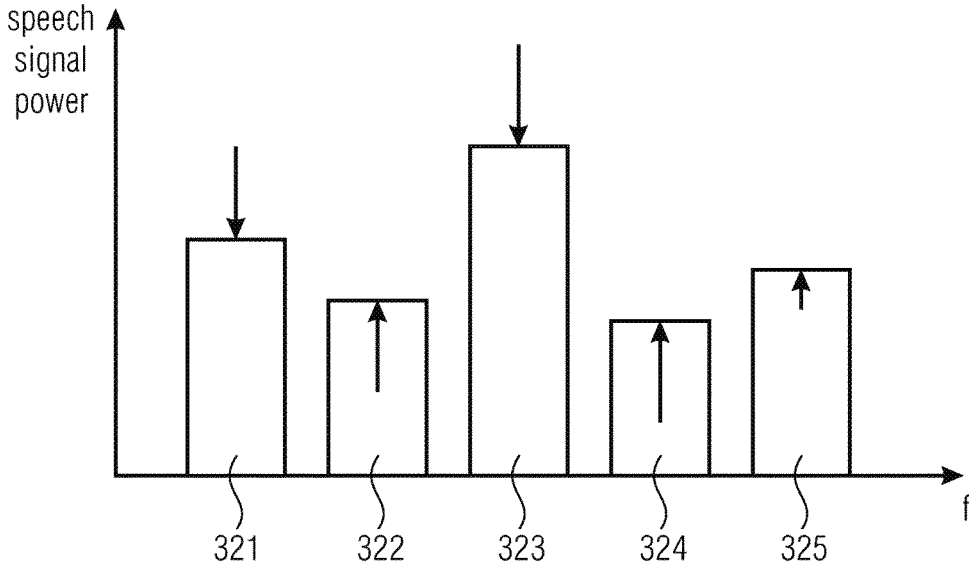
FIG. 3*b* illustrates the speech signal power of the modified subband signals that result from the amplification of the speech subband signals.

FIG. 3*a* and FIG. 3*b* illustrate this in more detail. In particular, FIG. 3*a* illustrates the speech signal power of the speech subband signals before an amplification of the speech subband signals takes place. FIG. 3*b* illustrates the speech signal power of the modified subband signals that result from the amplification of the speech subband signals.

FIGS. 3*a* and 3*b* illustrate an embodiment, where an original first signal power 311 of a first speech subband signal is amplified and is reduced by the amplification so that a smaller first signal power 321 of the first speech subband signal results. An original second signal power 312 of a second speech subband signal is amplified and is increased by the amplification so that a greater second signal power 322 of the first speech subband signal results. Thus, the first speech subband signal has been amplified with a first degree and the second speech subband signal has been amplified with a second degree, wherein the first degree is lower than the second degree. The first original signal power of the first speech subband signal was greater than the second original signal power of the second speech subband signal.

In FIGS. 3*a* and 3*b*, the signal powers 311 and 313 of the first and third speech subband signals are reduced by the amplification and the signal powers 312, 314, 315 of the second, the fourth and the fifth speech subband signals are increased by the amplification. Thus, the signal powers 311, 313 of the first and the third speech subband signals are each amplified with degrees which are lower than the degrees with which the second, the fourth and the fifth speech subband signals are amplified. The original signal powers 311, 313 of the first and the third speech subband signals were greater than the original signal powers 312, 314, 315 of the second, the fourth and the fifth speech subband signals.

Moreover, in FIGS. 3*a* and 3*b* it can be seen that the original signal power 312 of the second speech subband signal is greater than the original signal power 314 of the fourth speech subband signal. Although both the second and the fourth speech subband signals are increased by the amplification, the second subband signal is amplified with a degree being lower than the degree with which the fourth subband signal has been amplified, because the ratio of the modified (amplified) signal power 322 to the original signal power 312 of the second speech subband signal is lower than the ratio of the modified (amplified) signal power 324 to the original signal power 314 of the fourth speech subband signal.

For example, the modified (amplified) signal power 322 of the second speech subband signal is two times the size of the original signal power 312 of the second speech subband signal and so, the ratio of the modified signal power 322 to the original signal power 312 of the second speech subband power is 2. The modified (amplified) signal power 324 of the fourth speech subband signal is three times the size of the original signal power 314 of the fourth speech subband signal and so, the ratio of the modified signal power 324 to the original signal power 314 of the fourth speech subband power is 3.

Moreover, in FIGS. 3*a* and 3*b* it can be seen that the original signal power 313 of the third speech subband signal is greater than the original signal power 311 of the first speech subband signal. Although both the third and the first speech subband signals are reduced by the amplification, the third subband signal is amplified with a degree being lower than the degree with which the first subband signal has been amplified, because the ratio of the modified (amplified) signal power 323 to the original signal power 313 of the third speech subband signal is lower than the ratio of the modified (amplified) signal power 321 to the original signal power 311 of the first speech subband signal.

For example, the modified (amplified) signal power 323 of the third speech subband signal is 67% of the size of the original signal power 313 of the third speech subband signal and so, the ratio of the modified signal power 323 to the original signal power 313 of the second speech subband power is 0.67. The modified (amplified) signal power 321 of the first speech subband signal is 71% of the size of the original signal power 311 of the first speech subband signal and so, the ratio of the modified signal power 321 to the original signal power 311 of the fourth speech subband power is 0.71.

E.g., a degree with which a speech subband signal has been amplified to obtain a modified subband signal is the ratio of the signal power of the modified subband signal to the signal power of the speech subband signal.

When a first speech subband signal of the plurality of speech subband signals having a first signal power is amplified with a first degree, and when a second speech subband signal of the plurality of speech subband signals having a second signal power is amplified with a second degree, wherein the first degree is lower than the second degree, e.g., this means that the ratio of the signal power of a first modified subband signal resulting from the amplification of the first speech subband signal to the signal power of the first speech subband signal is lower than the ratio of the signal power of a second modified subband signal resulting from the amplification of the second speech subband signal to the signal power of the second speech subband signal.

According to an embodiment, the weighting information generator 110 may be configured to generate the weighting information for each of the plurality of speech subband signals and wherein the signal modifier 120 may be configured to modify each of the speech subband signals so that a first sum of all speech signal powers ($\Phi_n$ [l]) of all speech subband signals varies by less than 20% from a second sum of all speech signals powers of all modified subband signals.

In other words, dividing a first sum of all speech signal powers $\Phi_n$ [l] of all speech subband signals by a second sum of all speech signals powers of all modified subband signals results in a value d, for which $0.8 \leq d \leq 1.2$ holds true.

Figure 2:
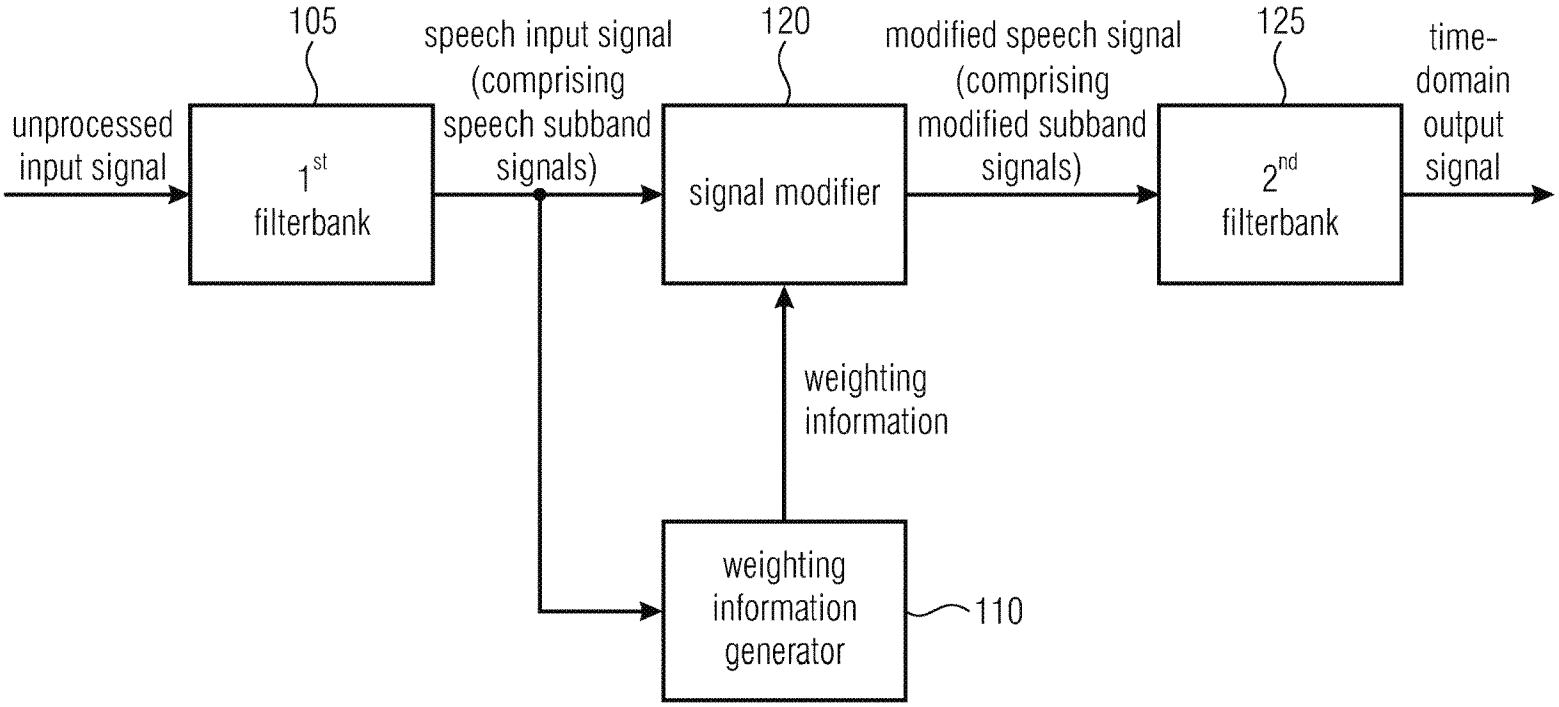
FIG. 2 illustrates an apparatus for generating a modified speech signal according to another embodiment.

FIG. 2 is an apparatus for generating a modified speech signal according to another embodiment.

The apparatus of FIG. 2 differs from the apparatus of FIG. 1 in that the apparatus of FIG. 2 further comprises a first filterbank 105 and a second filterbank 125.

The first filterbank 105 is configured to transform an unprocessed speech signal, being represented in a time domain, from the time domain to a subband domain to obtain the speech input signal comprising the plurality of speech subband signals.

The second filterbank 125 is configured to transform the modified speech signal, being represented in the subband domain and comprising the plurality of modified subband signals, from the subband domain to the time domain to obtain a time-domain output signal.

Figure 4A:
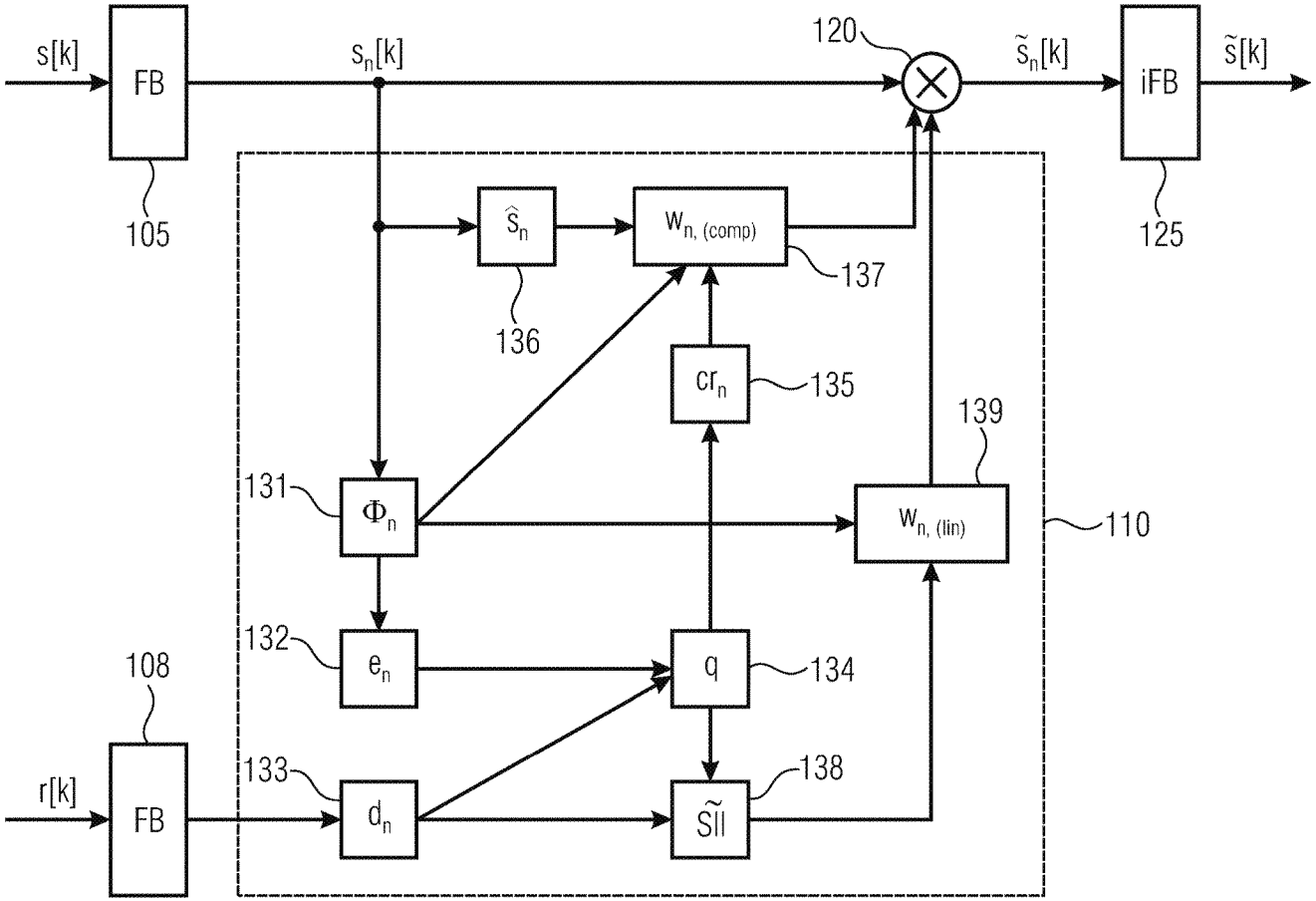
FIG. 4*a* illustrates an apparatus for generating a modified speech signal according to a further embodiment.

FIG. 4*a* illustrates an apparatus for generating a modified speech signal according to a further embodiment.

In contrast to the embodiment, of FIG. 2, the apparatus of FIG. 4*a* moreover, comprises a third filterbank 108, which transform a time-domain noise reference r [k] from a time domain to a subband domain to obtain a plurality of noise subband signals $r_n$ [k] of a noise input signal.

Moreover, the weighting information generator 110 according to the embodiment is shown in more detail. It comprises a speech signal power calculator 131 for calculating a speech signal power for each of the speech subband signals as described below. Moreover, it comprises a speech spectrum level calculator 132 for calculating a speech spectrum level for each of the speech subband signals as described below. Furthermore, it comprises a noise spectrum level calculator 133 for calculating a noise spectrum level for each of the noise subband signals of a noise input signal as described below.

In an embodiment, a noise subband signal $r_n$ [k] of the plurality of noise subband signals of the noise input signal is assigned to each speech subband signal $s_n$ [k] of the plurality of speech subband signals. E.g., each noise subband signal is assigned to the speech subband signal of the same subband. The weighting information generator 110 is configured to generate the weighting information of each speech subband signal $s_n$ [k] of the plurality of speech subband signals depending on the noise spectrum level $d_n$ [l] of the noise subband signal $r_n$ [k] of said speech subband signal ($s_n$ [k]). Moreover, the weighting information generator 110 is configured to generate the weighting information of each speech subband signal $s_n$ [k] of the plurality of speech subband signals depending on the speech spectrum level $e_n$ [l] of said speech subband signal.

Moreover, the weighting information generator 110 comprises an SNR calculator 134 for calculating a signal-to-noise ratio for each of the speech subband signals as described below.

For example, according to an embodiment, the weighting information generator 110 is configured to generate the weighting information of each speech subband signal $s_n$ [k] of the plurality of speech subband signals by determining the signal-to-noise ratio of said speech spectrum level $e_n$ [l] of said speech subband signal $s_n$ [k] and of said noise spectrum level $d_n$ [l] of the noise subband signal $r_n$ [k] of said speech subband signal $s_n$ [k]. E.g., the signal-to-noise ratio $q(e_n, d_n)$ of said speech spectrum level $e_n$ [l] of said speech subband signal $s_n$ [k] and of said noise spectrum level $d_n$ [l] of the noise subband signal $r_n$ [k] of said speech subband signal $s_n$ [k] may be defined according to the formula $$q(e_n, d_n) = \begin{cases} 0 & \text{if } e_n \leq d_n - 15\text{ dB} \\ \dfrac{e_n - d_n + 15\text{ dB}}{30\text{ dB}} & \text{if } d_n - 15\text{ dB} < e_n \leq d_n + 15\text{ dB} \\ 1 & \text{if } e_n > d_n + 15\text{ dB} \end{cases}$$

wherein $e_n$ is said speech spectrum level of said speech subband signal $s_n$ [k], and wherein $d_n$ is said noise spectrum level of the noise subband signal $r_n$ [k] of said speech subband signal $s_n$ [k].

Furthermore, the weighting information generator 110 comprises a compression ratio calculator 135 for calculating a compression ratio for each of the speech subband signals as described below.

For example, according to an embodiment, the weighting information generator 110, e.g., the compression ratio calculator 135, is configured to determine a compression ratio $cr_n$ [l] according to the formula $$cr_n[l] = \max\{cr_{(max)} \cdot (1 - q(e_n[l], d_n[l])), 1\}$$

wherein $q(e_n[l], d_n[l])$ is the signal-to-noise ratio of said speech spectrum level, wherein the signal-to-noise ratio $q(e_n[l], d_n[l])$ indicates a number between 0 and 1, wherein $cr_{(max)}$ indicates a fixed number, and wherein l indicates a block. n indicates one of the speech subband signals (the n-th speech subband signal).

It should be noted that each of the speech subband signals may comprise a plurality of blocks. Here, l indicates one block of the plurality of blocks of the n-th speech subband signal. Each block of the plurality of blocks may comprise a plurality of samples of the speech subband signal.

Moreover, the weighting information generator 110 comprises a smoothed signal amplitude calculator 136 for calculating a smoothed estimate of the envelope of the speech signal amplitude for each of the speech subband signals as described below.

For example, in an embodiment, the weighting information generator 110, e.g., the smoothed signal amplitude calculator 136, may be configured to determine the smoothed estimate of the envelope of the speech signal amplitude of said speech subband signal according to the formula $$\hat{s}_n[k] = \begin{cases} \hat{s}_n[k-1]\cdot\alpha_a + (1-\alpha_a)\cdot|s_n[k]| & \text{if } |s_n[k]| \geq \hat{s}_n[k-1] \\ \hat{s}_n[k-1]\cdot\alpha_r + (1-\alpha_r)\cdot|s_n[k]| & \text{if } |s_n[k]| < \hat{s}_n[k-1] \end{cases}$$

wherein $s_n$ [k] indicates said speech subband signal, wherein $|s_n[k]|$ indicates the amplitude of said speech subband signal, wherein $\alpha_a$ is a first smoothing constant and wherein $\alpha_r$ is a second smoothing constant.

Furthermore, the weighting information generator 110 comprises a compressive gain calculator 137 for calculating a compressive gain for each of the speech subband signals as described below.

For example, the weighting information generator 110 is configured to generate the weighting information of each speech subband signal $s_n$ [k] of the plurality of speech subband signals by determining, e.g., by employing the compressive gain calculator 137, the compressive gain $w_{n,(comp)}$ of said subband signal ($s_n$[k]) according to the formula $$w_{n,(comp)}[l\cdot M-m] = \sqrt{\left(\frac{\Phi_n[l]}{\hat{s}_n^2[l\cdot M-m]}\right)^{\frac{(\alpha_n[l]-1)}{\alpha_n[l]}}}, m = 0, \ldots, M-1,$$

wherein M indicates a length of the block l, wherein $\Phi_n$ [l] indicates the signal power of said speech subband signal $s_n$ [k], and wherein $\hat{s}_n^2[l\cdot M-m]$ indicates a square of a smoothed estimate of an envelope of a speech signal amplitude of said speech subband signal.

$\Phi_n$ [l] may indicate the speech signal power of said speech subband signal $s_n$ [k] for a (complete) block l of length M, wherein $\hat{s}_n^2[l\cdot M-m]$ may indicate the square of the smoothed estimate of the envelope of the speech signal amplitude of a particular sample of the block. A compression, e.g., a reduction of loud samples occurs, while quiet samples are increased.

Moreover, the weighting information generator 110 comprises a speech intelligibility index calculator 138 for calculating a speech intelligibility index as described below.

For example, in an embodiment, the weighting information generator 110, e.g., the speech integilibility index calculator 138, may be configured to determine the speech intelligibility index $\tilde{S}II$ [l] according to the formula $$\tilde{S}II[l] = \sum_{n=1}^{N} i_n \cdot q(e_n[l], d_n[l])\cdot \min\left\{1 - \frac{d_n[l] + 15\text{ dB} - u_n - 10\text{ dB}}{160\text{ dB}}, 1\right\},$$

wherein n indicates the n-th speech subband signal of the plurality of speech subband signals, wherein N indicates the total number of speech subband signals, wherein l indicates a block, wherein $q(e_n, d_n)$ indicates the signal-to-noise ratio of said speech spectrum level $e_n$ [l] of the n-th speech subband signal $s_n$ [k] and of said noise spectrum level $d_n$ [l] of the noise subband signal $r_n$ [k] of the n-th speech subband signal s [k], wherein $u_n$ indicates a speech spectrum level being a fixed value, and wherein $i_n$ indicates a band importance.

Furthermore, it comprises a linear gain calculator 139 for calculating a linear gain for each of the speech subband signals as described below.

For example, according to an embodiment, the weighting information generator 110 may be configured to generate the weighting information of the plurality of speech subband signals of the speech input signal by determining a speech intelligibility index $\tilde{S}II$ [l] and by determining for each speech subband signal $s_n$ [k] of the plurality of speech subband signal a signal-to-noise ratio $q(e_n, d_n)$ of the speech spectrum level $e_n$ [l] of said speech subband signal $s_n$ [k] and of said noise spectrum level $d_n$ [l] of the noise subband signal $r_n$ [k] of said speech subband signal $s_n$ [k]. The speech intelligibility index $\tilde{S}II$ indicates a speech intelligibility of the speech input signal.

For example, the weighting information generator 110 may be configured to generate the weighting information of each speech subband signal $s_n$ [k] of the plurality of speech subband signals by determining, e.g., by employing the linear gain calculator 139, a linear gain $w_{n,(lin)}$ for each subband signal $s_n$ [k] of the plurality of speech subband signals depending on the speech intelligibility index $\tilde{S}II$[l], depending on the signal power $\Phi_n$ [l] of said speech subband signal $s_n$ [k] and depending on the sum ($\Phi_{(max)}$ [l]) of the signal powers of all speech subband signals of the plurality of speech subband signals.

E.g., the weighting information generator 110 may be configured to generate a linear gain $w_{n,(lin)}$ for each speech subband signal $s_n$ [k] of the plurality of speech subband signals according to the formula $$w_{n,(lin)}[l] = \sqrt{\frac{\Phi_n^{\tilde{S}II}[l]}{\sum_{\lambda=1}^{N}\Phi_\lambda^{\tilde{S}II}[l]}\cdot\frac{\Phi_{(max)}[l]}{\Phi_n[l]}}$$

wherein n indicates the n-th speech subband signal of the plurality of speech subband signals, wherein N indicates the total number of speech subband signals, wherein l indicates a block, wherein $\Phi_n$ [l] indicates the signal power of the n-th speech subband signal, and wherein $\Phi_{(max)}$ [l] indicates the sum of the signal powers of all speech subband signals of the plurality of speech subband signals. E.g., $\Phi_{(max)}$ [l] indicates the broadband power of the speech signal in block l.

To improve the readability of the above formula, the dependency of $\tilde{S}II$ on block l is not explicitly stated. However, it should be noted that $\tilde{S}II$ depends on block l.

The $\tilde{S}II$ [l] may be an index between 0 (no intelligibility) and 1 (perfect intelligibility). Considering the extreme cases $\tilde{S}II$ [l]=0 and $\tilde{S}II$ [l]=1 for the above formula for $w_{n,(lin)}$:

If $\tilde{S}II$ [l]=1, the numerator of the first factor and the denominator of the second factor are equal and can be thus be removed from the above formula for $w_{n,(lin)}$. Moreover, if $\tilde{S}II$ [l]=1, the numerator of the second factor and the denominator of the first factor are equal and can be thus also be removed from the above formula for $w_{n,(lin)}$. Thus, when the speech intelligibility is perfect, $w_{n,(lin)}$ becomes 1, and the signal, e.g., will not be modified.

If $\tilde{S}II$ [l]=0, the first factor becomes 1/N, so that, e.g., the total power is equally spread among all N frequency bands.

Figure 5A:
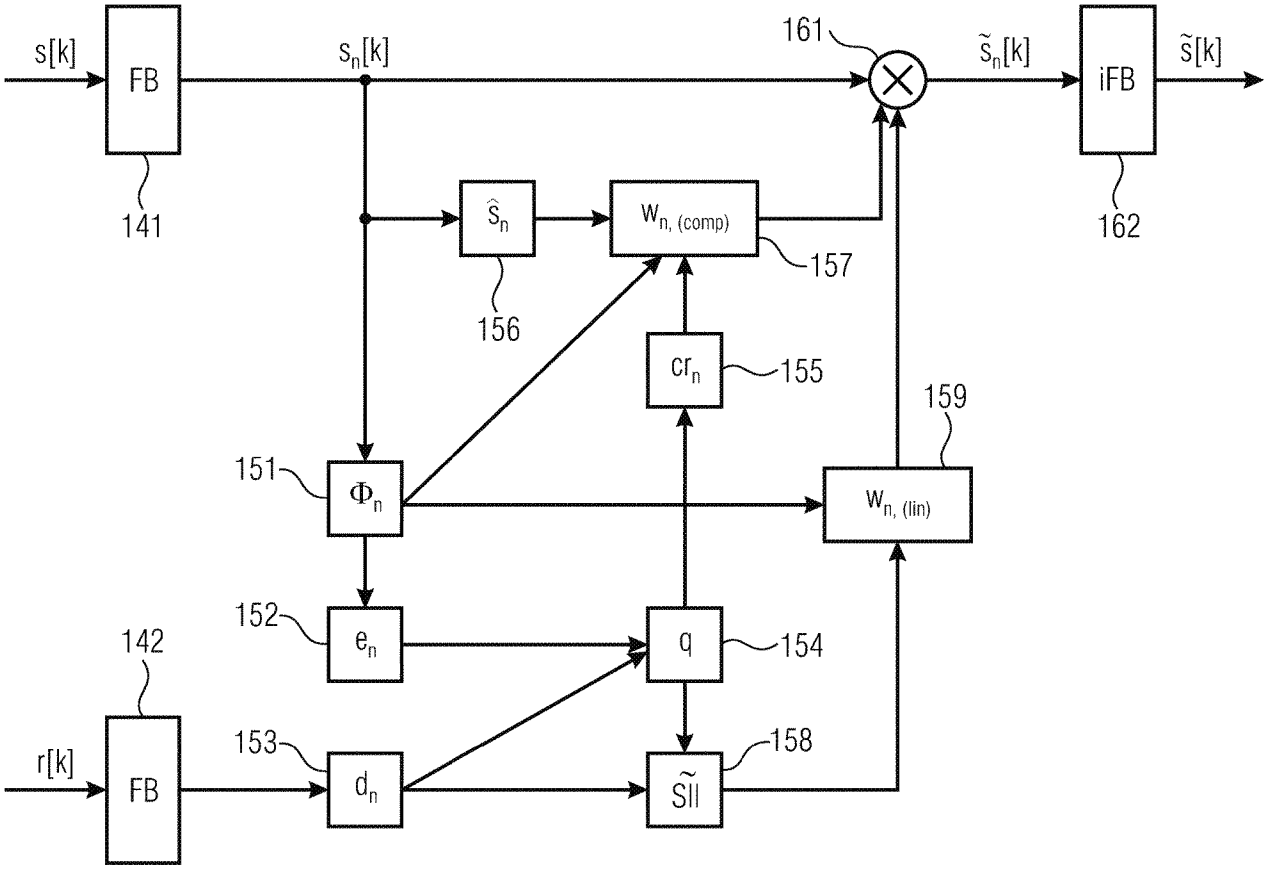
FIG. 5*a* illustrates a flow chart of the described algorithm according to an embodiment.

FIG. 5*a* illustrates a flow chart of an algorithm according to an embodiment.

In step 141, the unprocessed speech signal s [k] being represented in a time domain is transformed from the time domain to a subband domain to obtain the speech input signal being represented in the subband domain, wherein the speech input signal comprises the plurality of speech subband signals $s_n$ [k].

In step 142, the time-domain noise reference r [k] being represented in the time domain is transformed from the time domain to the subband domain to obtain the plurality of noise subband signals $r_n$ [k].

In step 151, calculating a speech signal power for each of the speech subband signals as described below is conducted. Moreover, in step 152, calculating a speech spectrum level for each of the speech subband signals as described below is performed. Furthermore, in step 153, calculating a noise spectrum level for each of the speech subband signals as described below is conducted. Moreover, in step 154, calculating a signal-to-noise ratio for each of the speech subband signals as described below is performed. Furthermore, in step 155, calculating a compression ratio for each of the speech subband signals as described below is conducted. Moreover, in step 156, calculating a smoothed estimate of the envelope of the speech signal amplitude for each of the speech subband signals as described below is performed. Furthermore, in step 157, calculating a compressive gain for each of the speech subband signals as described below is conducted. Moreover, in step 158, calculating a speech intelligibility index as described below is performed. Furthermore, in step 159 calculating a linear gain for each of the speech subband signals as described below is conducted.

In step 161, the plurality of speech subband signals are amplified by applying the compressive gains of the speech subband signals and by applying the linear gains of the speech subband signals on the respective speech subband signals, as described below.

In step 162, the modified speech signal comprising the plurality of modified subband signals is transformed from the subband domain to the time domain to obtain a time-domain output signal ŝ [k].

Figure 4B:
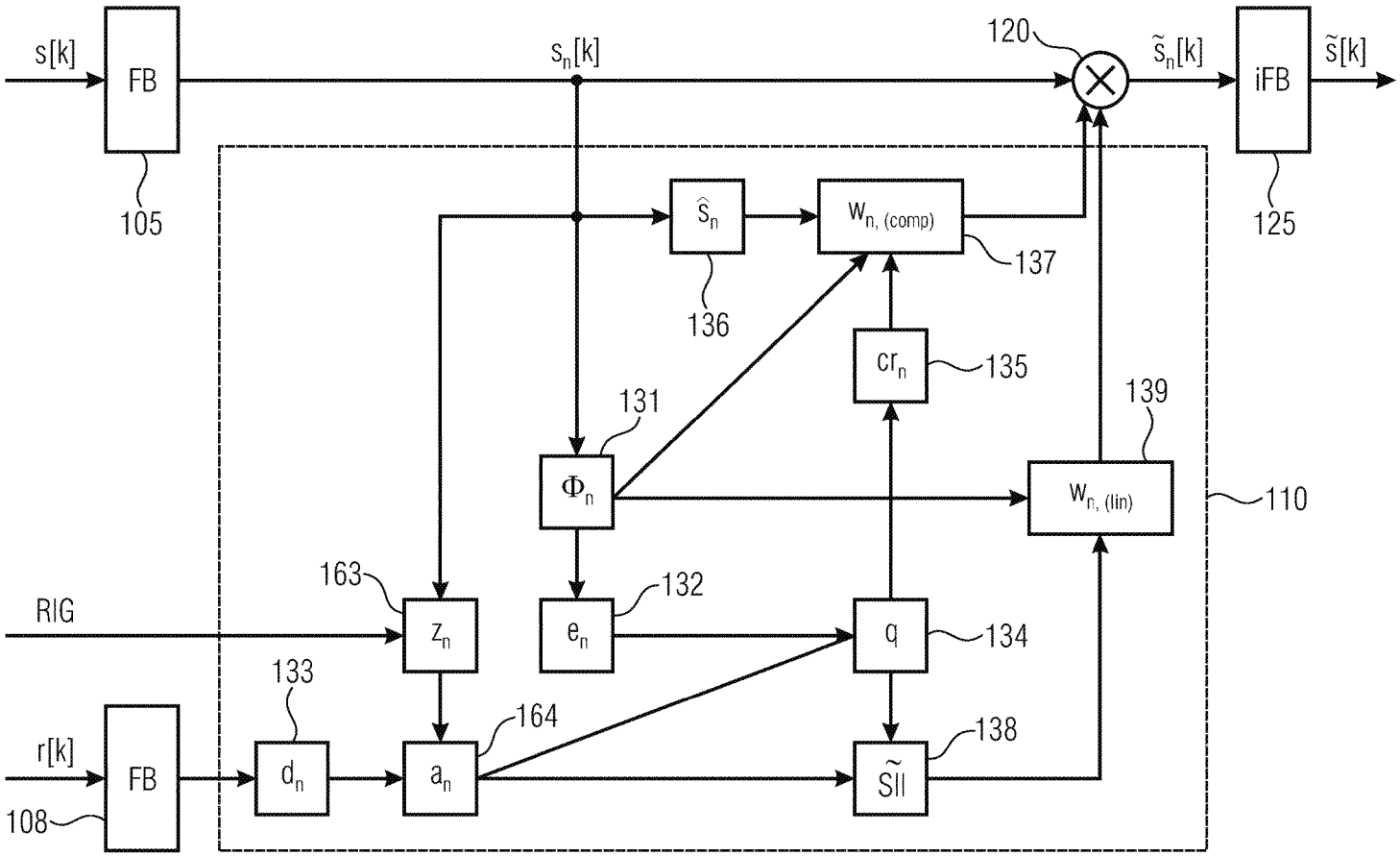
FIG. 4*b* illustrates an apparatus for generating a modified speech signal according to another embodiment.

FIG. 4*b* illustrates an apparatus for generating a modified speech signal according to another embodiment.

In the embodiment illustrated by FIG. 4*b*, room acoustical information may be considered in the proposed algorithm. The speech signal is played back by a loudspeaker and the disturbed speech signal is picked up by a microphone. The recorded signal consist of the noise r[k] and the reverberant speech signal. Some parts of the reverberation contained in the reverberant speech signal can be considered detrimental while other parts may be considered useful for speech intelligibility. Using a room acoustical information generator (RIG), for example a filter modeling the room impulse response between a loudspeaker and a microphone, the reverberation time T60 (defined as the time to decay by 60 db) or the direct-to-reverberation energy ratio (DRR), a reverberation spectrum level $z_n[l]$ may be calculated by the weighting information generator 110, e.g., by a reverberation spectrum level calculator 163, using the information provided by the room acoustical information generator and the subband speech signals $s_n[k]$ in each subband. A weighted addition $a_n[l]$ $$a_n[l]=\beta z_n[l]+d_n[l]$$

with weighting factor β may be determined by the weighting information generator 110, e.g., by a weighted adder 164, and the weighted addition $a_n[l]$ may be used in subsequent calculations, where otherwise only the noise spectrum level $d_n[l]$ is used.

All formulas that have been defined for $d_n$ are also applicable for $a_n$ by replacing $d_n$ by $a_n$. For example, according to some embodiments, in equation (4), equation (5) and/or in equation (8), $d_n$ may be replaced by $a_n$ and these formulas may take by this the weighted addition $a_n$ into account.

For example, β may be a real value, wherein, e.g., $0 \le \beta \le 1$ may apply.

In essence $a_n$ may takes into account additional information about reverberation (e.g., room impulse response, T60, DRR).

In the following, concepts of embodiments, inter alia employed by the embodiments of FIG. 1, FIG. 2, FIG. 4*a*, FIG. 4*b*, FIG. 5*a* and FIG. 5*b* are explained in more detail.

The clean speech signal (also referred to as "unprocessed speech signal") at the input of the algorithm is denoted by s [k] at discrete time index k.

The noise reference (e.g. being represented in a time domain) is denoted by r [k] and can be recorded with a reference microphone.

Both signals are split in octave band by means of a filterbank, e.g. an IIR-filterbank without decimation, e.g., see Vaidyanathan et al. (1986), (see [4]). The resulting subband signals are denoted by $s_n$ [k] and $r_n$ [k] for s [k] and r [k] respectively.

The subband speech signal power $\Phi_n$ [l] for a block l of length M is calculated as:

$$\Phi_n[l] = \frac{1}{M} \sum_{k=lM-M+1}^{lM} s_n^2[k] \tag{1}$$

With the help of equation 1 and the bandwidth $\Delta f_n$ of the octave band with center frequency $f_n$ the equivalent speech spectrum level can be calculated:

$$e_n[l] = 10 \cdot \log_{10}\left(\frac{\phi_n[l]}{\Delta f_n}\right) \tag{2}$$

The same can be done for the noise subband signal $r_n$ [k] (which may also be referred to as a "noise reference signal") leading to the equivalent noise spectrum level $$d_n[l] = 10 \cdot \log_{10}\left(\frac{1}{M \cdot \Delta f_n} \sum_{k=lM-M+1}^{lM} r_n^2[k]\right) \tag{3}$$

For each block then a mapping for the signal-to-noise ratio (SNR) can be computed $$q(e_n, d_n) = \begin{cases} 0 & \text{if } e_n \le d_n - 15 \text{ dB} \\ \dfrac{e_n - d_n + 15 \text{ dB}}{30 \text{ dB}} & \text{if } d_n - 15 \text{ dB} < e_n \le d_n + 15 \text{ dB} \\ 1 & \text{if } e_n > d_n + 15 \text{ dB} \end{cases} \tag{4}$$

Using this mapping function from equation 4, the compression ratio in each frequency channel can be calculated using a predefined maximum compression ratio cr(max), which is typically set to a value of $cr_{(max)}=8$:

$$cr_n[l]=\max\{cr_{(max)}\cdot(1-q(e_n[l],d_n[l])),1\}. \tag{5}$$

Furthermore, a smoothed estimate of the instantaneous envelope of the speech signal amplitude is calculated as:

$$\hat{s}_n[k] = \begin{cases} \hat{s}_n[k-1]\cdot\alpha_a + (1-\alpha_a)\cdot|s_n[k]| & \text{if } |s_n[k]| \ge \hat{s}_n[k-1] \\ \hat{s}_n[k-1]\cdot\alpha_r + (1-\alpha_r)\cdot|s_n[k]| & \text{if } |s_n[k]| < \hat{s}_n[k-1] \end{cases} \tag{6}$$

where $\alpha_a$ and $\alpha_r$ are the smoothing constants for the cases of an increasing signal amplitude and decreasing signal amplitude, respectively.

Using $\Phi_n[l]$, $cr_n[l]$ and $\hat{s}$ [k] the compressive gain $w_{n,(comp)}[k]$ is calculated as follows:

$$w_{n,(comp)}[l\cdot M-m]=\sqrt{\left(\frac{\phi_n[l]}{\hat{s}_n^2[l\cdot M-m]}\right)^{\frac{(cr_n[l]-1)}{cr_n[l]}}},\quad m=0,\ldots,M-1, \tag{7}$$

where l·M−m=k.

Furthermore an estimate of the Speech Intelligibility Index (SII) is calculated as:

$$\tilde{SII}[l]=\sum_{n=1}^{N} i_n\cdot q(e_n[l],d_n[l])\cdot\min\left\{1-\frac{d_n[l]+15\text{ dB}-u_n-10\text{ dB}}{160\text{ dB}},1\right\}, \tag{8}$$

where $u_n$ is defined according to ANSI (1997) as the standard equivalent speech spectrum level. E.g., $u_n$ may be a fixed value.

Here, N e.g. indicates the total number of subbands. $i_n$ e.g, may be a band importance function, e.g, indicating a band importance for the n-th subband, wherein $i_n$ is, e.g., a value between 0 and 1, wherein the $i_n$ values of all N subbands, e.g, sum up to 1.

The term $$\min\left\{1-\frac{d_n[l]+15\text{ dB}-u_n-10\text{ dB}}{160\text{ dB}},1\right\}$$

is adopted from Sauert and Vary (2010) (see [2]).

The SII-value may, e.g., be a value between 0 and 1, wherein 1 indicates a very good speech intelligibility and wherein 0 indicates a very bad speech intelligibility.

Using this estimated SII a so called linear gain function is calculated:

$$w_{n,(lin)}[l]=\sqrt{\frac{\phi_n^{\tilde{SII}}[l]}{\sum_{\lambda=1}^{N}\phi_\lambda^{\tilde{SII}}[l]}\cdot\frac{\phi_{(max)}[l]}{\phi_n[l]}}. \tag{9}$$

To improve the readability of the above formula (9), the dependency of $\tilde{SII}$ on block l is not explicitly stated. However, it should be noted that $\tilde{SII}$ depends on block l.

$\Phi_{(max)}$ [l] indicates the sum of the signal powers of all speech subband signals of the plurality of speech subband signals. E.g., $\Phi_{(max)}$ [l] indicates the broadband power of the speech signal in block l.

Both gain functions are then combined and the subband signals are multiplied with the respective gain function, i.e.:

$$\tilde{s}_n[lM-m]=[lM-m]w_{n,lin}[l]w_{n,comp}[lM-m] \tag{10}$$

$$w_n[lM-m]=w_{n,lin}[l]w_{n,comp}[lM-m] \tag{11}$$

and equation 10 is therefore equivalent to $$\tilde{s}_n[lM-m]=s_n[lM-m]w_n[lM-m]. \tag{12}$$

According to one embodiment, now, the inverse filterbank is applied, and the modified speech signal is reconstructed.

According to another embodiment, however, before applying the inverse filterbank to generate the modified speech signal, a smoothing procedure is applied to $w_n$[lM−m] to avoid rapid changes in the gain function especially at block boundaries.

In an embodiment, the weighting information generator 110 is configured to generate the weighting information $\overline{w}_n$ of each speech subband signal $s_n$ [k] of the plurality of speech subband signals by applying the formula $$\overline{w}_n[l\cdot M-m]=\alpha_p\overline{w}_n[l\cdot M-m-1]+(1-\alpha_p)p_{\overline{\lambda}_n[l]}(\hat{s}_n^2[l\cdot M-m])$$

wherein n indicates the n-th speech subband signal of the plurality of speech subband signals, wherein N indicates the total number of speech subband signals, wherein l indicates a block, wherein $\alpha_p$ is a smoothing constant, and wherein $\hat{s}_n^2$[l·M−m] indicates a square of a smoothed estimate of an envelope of a speech signal amplitude of said speech subband signal.

In the following, the smoothing according to an embodiment is described.

The smoothing is applied to the underlying Input-Output-Characteristic (IOC) of $w_n$[lM−m]. The Input-Output-Characteristic is defined by a set of input and output powers $\gamma_{n,i}$[l] and $\xi_{n,i}$[l] which are part of the parameter vector $\lambda_n$[l], i.e.

$$\lambda_n[l]=[\gamma_{n,1}[l]\gamma_{n,2}[l]\gamma_{n,3}[l]\xi_{n,1}[l]\xi_{n,2}[l]\xi_{n,3}[l]] \tag{13}$$

The Input-Output-Characteristic is then defined by:

$$\gamma_{n,1}[l]=1 \tag{14}$$

$$\gamma_{n,2}[l]=\Phi_n[l] \tag{15}$$

$$\gamma_{n,3}[l]=v \tag{16}$$

and $$\xi_{n,1}[l]=w_{n,(lin)}[l](\varphi_n[l])^{(1-1/cr_n[l])} \tag{17}$$

$$\xi_{n,2}[l]=w_{n,(lin)}[l]\varphi_n[l] \tag{18}$$

$$\xi_{n,3}[l]=w_{n,(lin)}[l](\varphi_n[l])^{(1-1/cr_n[l])}v^{1/cr_n[l]} \tag{19}$$

where v converts dB FS to dB SPL, e.g. assuming that 0 dB FS are equal to 100 dB SPL $v=10^{(100/10)}$. Defining a function $p\lambda_{n[l]}(\hat{s}_n^2$[l·M−m]) that performs linear interpolation and extrapolation of the IOC, for example, defined by the above parameter in the decibel domain depending on the current input power $\hat{s}_n^2$[l·M−m], for example, a smoothed estimate of an envelope of the speech signal amplitude, e.g., as defined according to equation 6. Thus, it can be written:

$$w_n[l\cdot M-m]=p_{\lambda_{n[l]}}(\hat{s}_n^2[l\cdot M-m]) \tag{20}$$

A recursive smoothing is then applied to each element $\lambda_{n,j}$[l] of the parameter vector $\lambda_n$[l], yielding $$\overline{\lambda}_{n,j}[l]=\alpha_\lambda\overline{\lambda}_{n,j}[l-1]+(1-\alpha_\lambda)\lambda_{n,j}[l] \tag{21}$$

and the smoothed parameter vector $\overline{\lambda}_n$[l] with $\alpha_\lambda$ smoothing constant.

The smoothed gain is then calculated as $$\overline{w}_n[l\cdot M-m]=\alpha_p\overline{w}_n[l\cdot M-m-1]+(1-\alpha_p)p_{\overline{\lambda}_n[l]}(\hat{s}_n^2[l\cdot M-m]) \tag{22}$$

with $\alpha_p$ being a smoothing constant to further smooth the gain function over time.

$p_{\overline{\lambda}_n[l]}(\hat{s}_n^2$[l·M−m]) is defined as a function that performs linear interpolation and extrapolation of the smoothed Input-Output-Characteristic $\overline{\lambda}_n$[l], wherein $\overline{\lambda}_n$[l] is e.g., defined as defined by equation (13) and equation (21).

The output signal then yields $$\tilde{s}_n[lM-m]=s_n[lM-m]\overline{w}_n[lM-m] \tag{23}$$

Finally, the inverse filterbank is applied and the modified speech signal $\tilde{s}[k]$ is reconstructed.

To reduce differences between input and output power the power in each block is normalized by means of smoothed power estimates at the output and input of the algorithm. Therefore, the smoothed input power is defined as:

$$\tilde{\varphi}_s[l]=\alpha_L\tilde{\varphi}_s[l-1]+(1-\alpha_L)\varphi_s[l] \tag{24}$$

where $\alpha_L$ is a smoothing constant and $\varphi_s$ [l] is calculated according to equation 1 using the broadband input signal s[k] and not the subband signals. The smoothed output power $\tilde{\varphi}_{\tilde{s}}$ [l] is then calculated using the output signal $\tilde{s}$ [k] of the algorithm.

The signal to be played back is then computed as:

$$\tilde{s}'[lM-m]=\sqrt{\frac{\tilde{\phi}_s[l]}{\tilde{\phi}_{\tilde{s}}[l]}}\,\tilde{s}[lM-m] \tag{25}$$

Embodiments differ from the known technology in several ways.

For example, some embodiments combine a multi-band spectral shaping algorithm and a multi-band compression scheme, in contrast to Zorila et al. (2012a,b) (see [5], [6]) wherein a multi-band spectral shaping algorithm and a single-band compression scheme is combined.

The provided concepts combine, in contrast to the known technology a linear and a compressive gain, wherein both the linear gain and the compressive gain are time-variant and adapt to the instantaneous speech signals and noise signals.

Moreover, some embodiments apply an adaptive compression ratio in each frequency band, in contrast to Zorila et al. (2012a,b) (see [5], [6]) who use a static compression scheme.

Furthermore, according to some embodiments, the compression ratio is selected based on functions that are used to calculate the SII and are therefore related to speech perception.

Moreover, in some embodiment, a uniform weighting of frequency bands is used in the linear gain function, while other related algorithms use different weightings, see Sauert and Vary, 2012 (see [3]).

Furthermore, some embodiments use (an estimate of) the SII, which is related to speech perception, to crossover between no weighting and a uniform weighting of all bands.

The provided embodiments lead to improved intelligibility when listening to speech in noisy environments. The improvement can be significantly higher than with existing methods. The provided concepts differ from the known technology in different ways as described above.

Algorithms according to the state of the art, e.g. the mentioned ones, can also improve intelligibility, but the special features of the provided embodiments make it more efficient than currently available methods.

The provided embodiments, e.g., the provided methods, can be used as part of a signal processor or as signal processing software in many technical applications with audio playback, e.g.:

- PA-Systems in train stations, public transport, schools.
- Communication devices such as mobile phones, headsets.
- Infotainment systems in cars, in-flight entertainment systems.
- As a tool for improving intelligibility of speech in media files consisting of several audio stems prior to signal mixing (e.g. during mixing of movie audio material).

Furthermore, the provided embodiments may also be used for other types of signal disturbances such as reverberation, which can be treated similarly to the noise in the form of the algorithm described above.

Figure 5B:
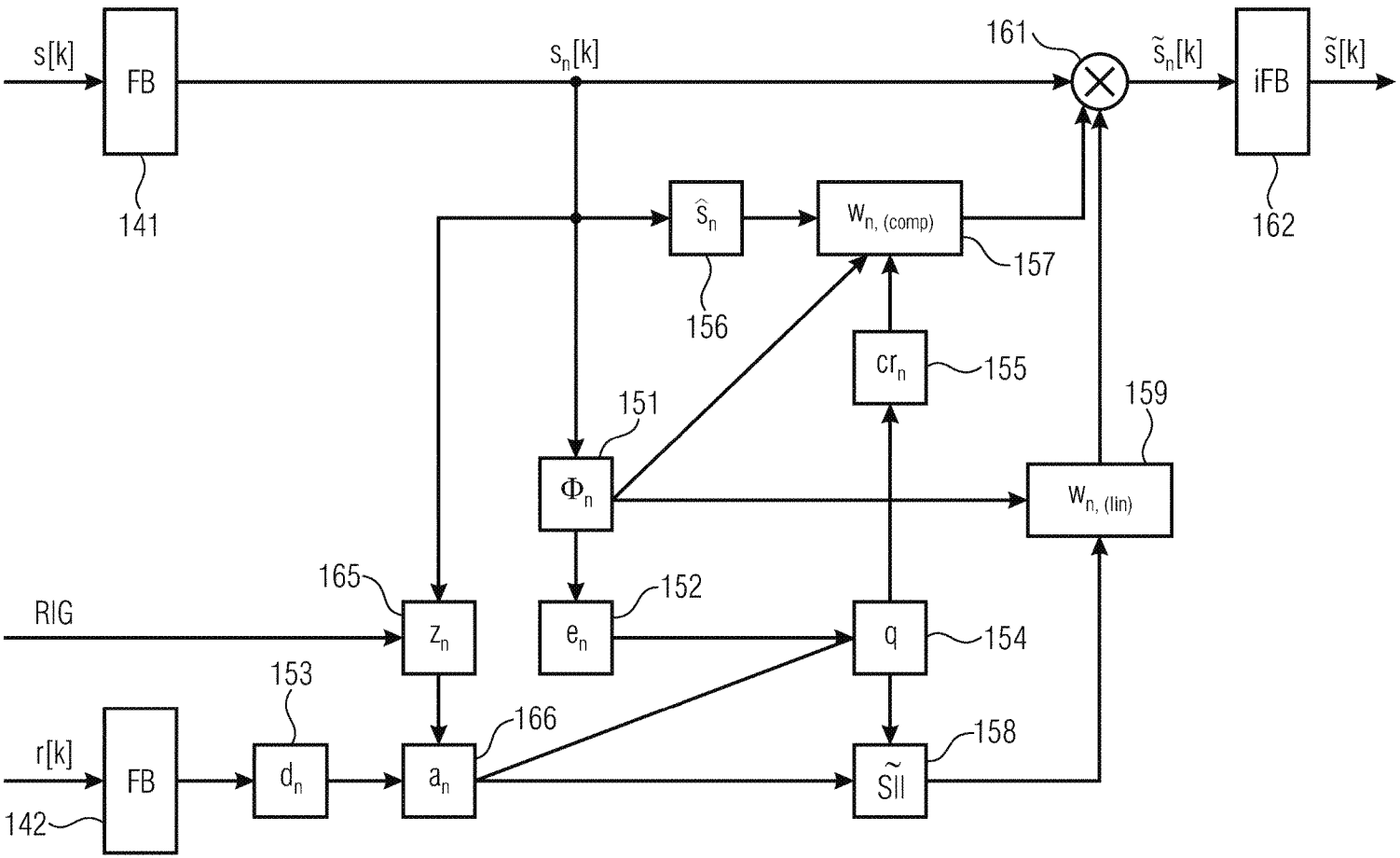
FIG. 5*b* illustrates a flow chart of the described algorithm according to another embodiment.

FIG. 5*b* illustrates a flow chart of the described algorithm according to another embodiment.

In the embodiment illustrated by FIG. 5*b*, room acoustical information may be considered in the proposed algorithm. The speech signal is played back by a loudspeaker and the disturbed speech signal is picked up by a microphone. The recorded signal consist of the noise r[k] and the reverberant speech signal. Some parts of the reverberation contained in the reverberant speech signal can be considered detrimental while other parts may be considered useful for speech intelligibility. Using a room acoustical information generator (RIG), for example a filter modeling the room impulse response between a loudspeaker and a microphone, the reverberation time T60 or the direct-to-reverberation energy ratio (DRR), a reverberation spectrum level $z_n$[l] may be calculated (see 165) using the information provided by the room acoustical information generator and the subband speech signals $s_n$[k] in each subband. A weighted addition $a_n$[l]

$$a_n[l]=\beta z_n[l]+d_n[l]$$

with weighting factor β may be determined (see 166), and the weighted addition $a_n$[l] may be used in subsequent calculations, where otherwise only the noise spectrum level $d_n$[l] is used.

All formulas that have been defined for $d_n$ are also applicable for $a_n$ by replacing $d_n$ by $a_n$. For example, in equation (4), equation (5) and/or in equation (8), $d_n$ may be replaced by $a_n$ and these formulas may take by this the weighted addition $a_n$ into account.

For example, β may be a real value, wherein, e.g., $0\leq\beta\leq1$ may apply.

The performance of the proposed algorithm has been compared to a state-of-the-art algorithm that uses only a time-and-frequency-dependent gain characteristic and the unprocessed reference signal, using subjective listening tests. Listening tests were conducted with eight normal-hearing subjects with two different noise types, namely a stationary car noise and a more non-stationary cafeteria noise. For each noise type three different SNRs were measured, corresponding to points of 20%, 50% and 80% word intelligibility in the unprocessed reference condition. The results indicate that the proposed algorithm outperforms the state-of-the-art algorithm and the unprocessed reference in both noise scenarios at equal speech levels. Furthermore, correlation analyses between objective measures and the subjective data show high correlations of ranks as well as high linear correlations, suggesting that objective measures can partially be used to predict the subjective data in the evaluation of preprocessing algorithms.

As has been described above, concepts for improving speech intelligibility in background noise by SII-dependent amplification and compression have been provided.

As described above, often, clean speech signals can be provided in a communication device, e.g. public address system, car navigation system or mobile phone. However, still, sometimes speech is not intelligible due to disturbances at the near-end listener. Above-described embodiments modify the clean speech signal to enhance intelligibility and/or listening comfort in a given disturbed acoustic scenario.

Figure 6:
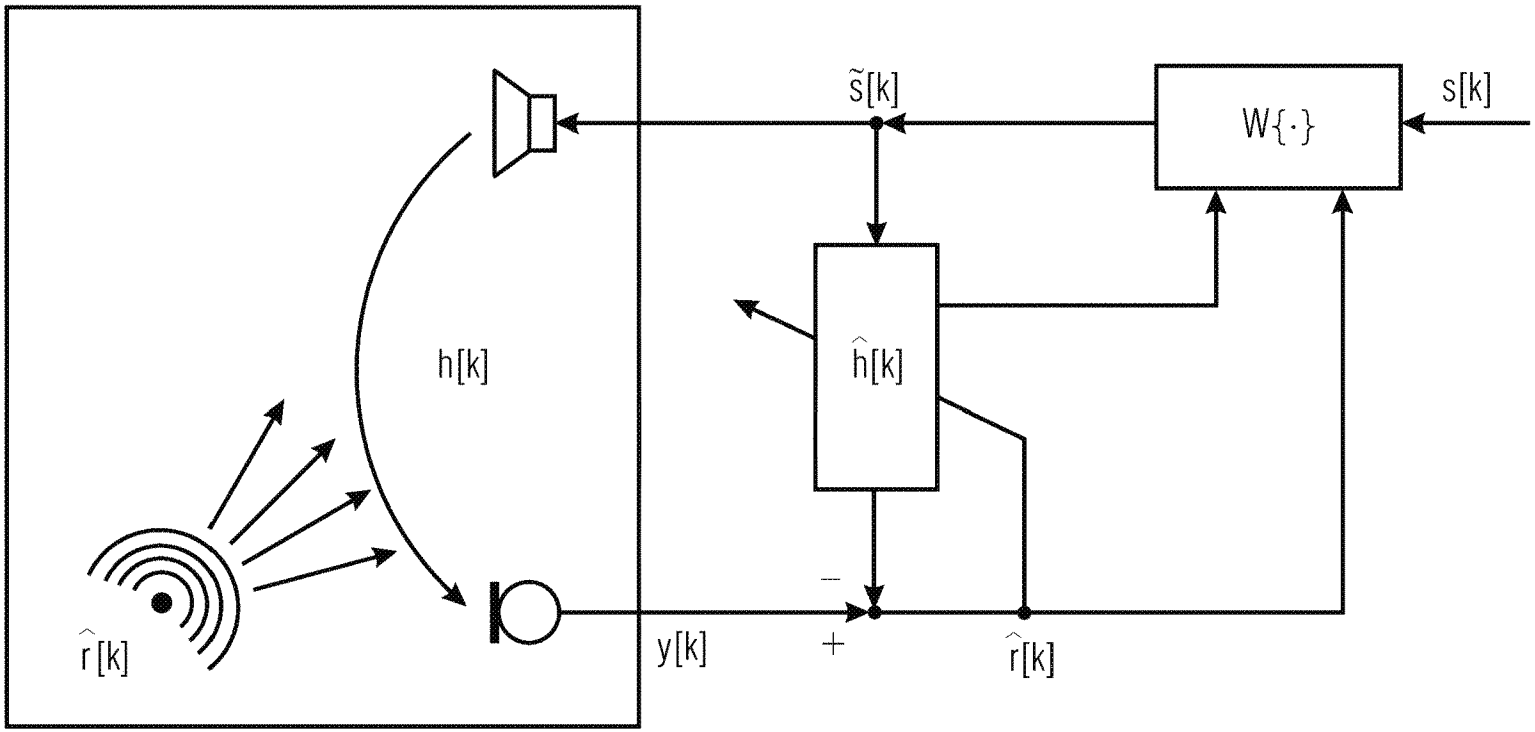
FIG. 6 illustrates a signal model, where near-end listening enhancement according to an embodiment is provided.

FIG. 6 illustrates a scenario, where near-end listening enhancement according to embodiments is provided. In particular, FIG. 6 illustrates a signal model, where near-end listening enhancement according to an embodiment is provided.

In FIG. 6 the formula $$\tilde{s}[k]=W\{s[k],\hat{r}[k],\hat{h}[k]\}\cdot s[k]$$

may apply.

It may be assumed that a perfect noise estimate is possible, e.g. that $$\hat{r}[k]=r[k].$$

Moreover, in cases where no reverberation exists, then $$h[k]=\delta[k].$$

Considering also reverberation this would not hold in all conditions, but instead it may be assumed that a perfect estimate of the some room information is possible, for example the room impulse response h[k].

It may be desired to find a weighting function W{·} that enhances the intelligibility s̃[k]+r[k] in comparison to s[k]+r[k] under equal power constraint.

According to an equal power constraint, the weighting function W{·} may be determined such that the overall power in all subbands may roughly be the same before amplification and after amplification.

Figure 7:
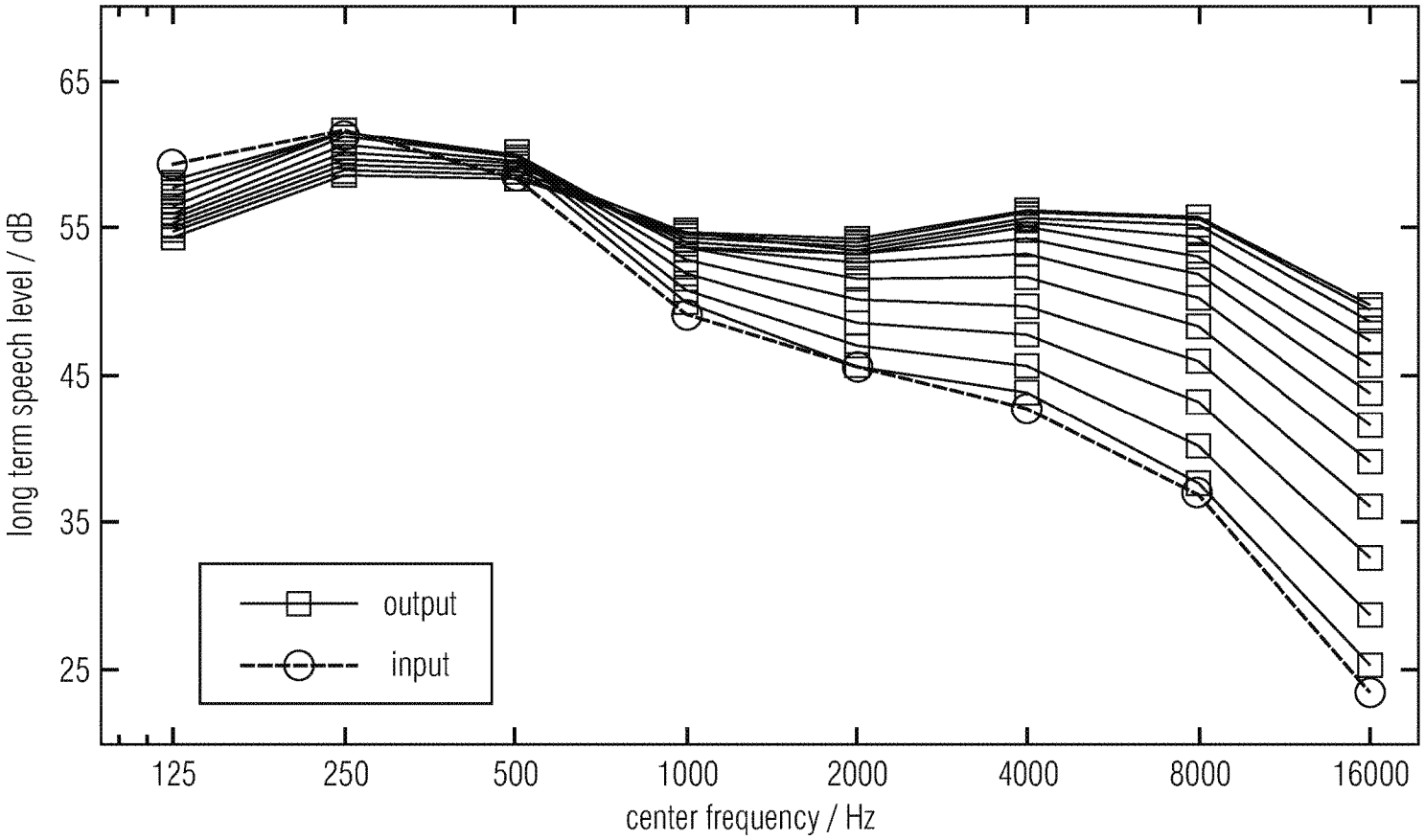
FIG. 7 illustrates the long term speech levels for center frequencies from 1 to 16000 Hz.

FIG. 7 illustrates the long term speech levels for center frequencies from 1 to 16000 Hz. In particular, the long term speech levels for one speech input signal and a plurality of modified speech signals are illustrated.

An algorithm according to an embodiment estimates the SII from s[k] and r̂[k], and combines two SII-dependent stages, in particular, a multi-band frequency shaping and a multi-band compression scheme.

A subjective evaluation has been conducted. The processing conditions comprised a subjective evaluation regarding an unprocessed reference ("Reference"), regarding a speech signal resulting from a processing with an algorithm according to an embodiment ("DynComp"), and regarding a speech signal resulting from a processing with a modified algorithm originally proposed by Sauert 2012, ITG Speech Communication, Braunschweig, Germany, see [3] ("Mod-Sau").

Regarding the subjective evaluation, eight normal-hearing subjects participated. Two different noises were tested, namely car-noise and cafeteria-noise. Speech material from the Oldenburg Sentence Test has been used. SNRs were chosen with the objective of measuring points of 20%, 50% and 80% word intelligibility.

Figure 8:
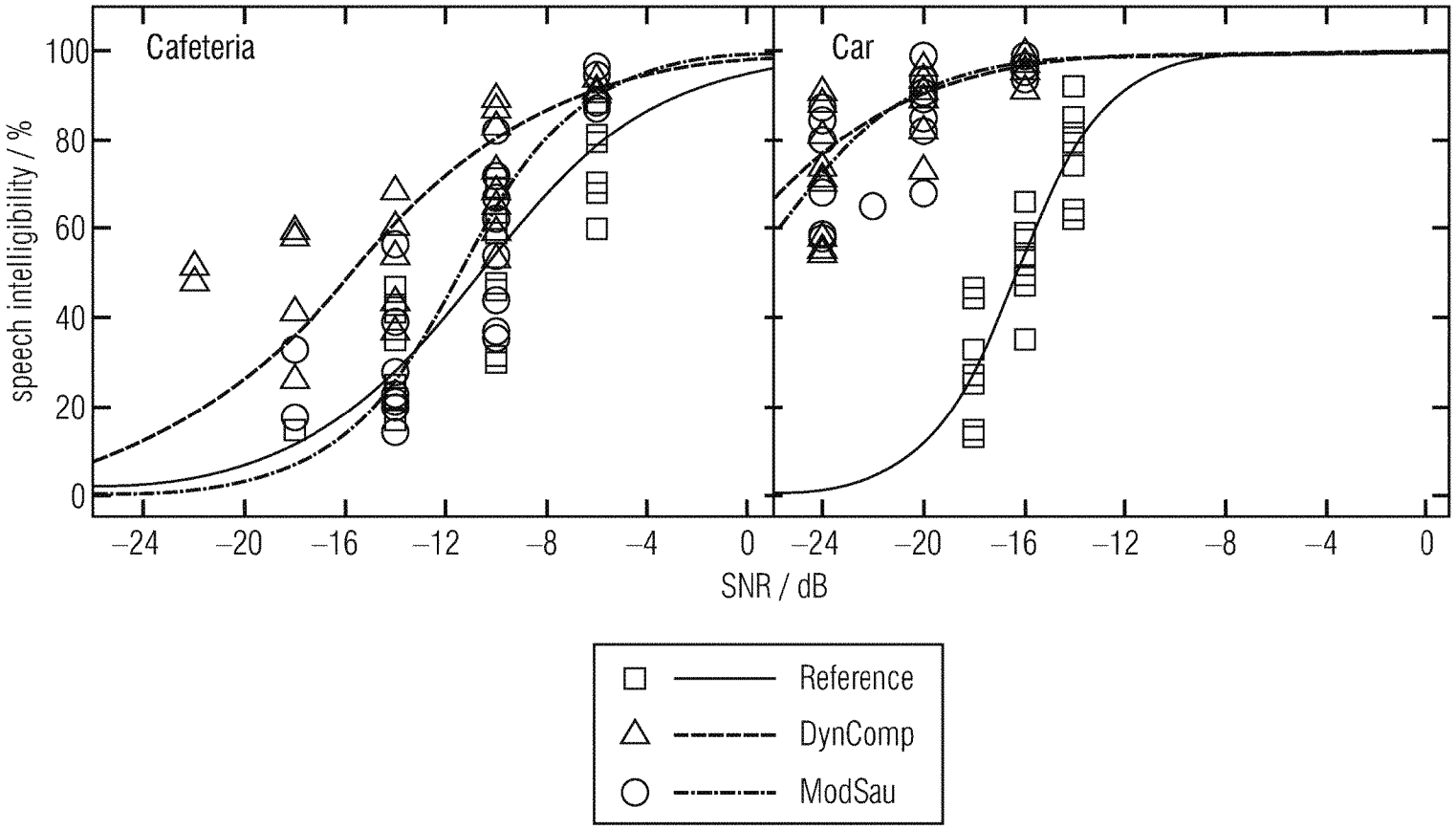
FIG. 8 illustrates the results from the subjective evaluation.

FIG. 8 illustrates the results from the subjective evaluation.

Figure 9:
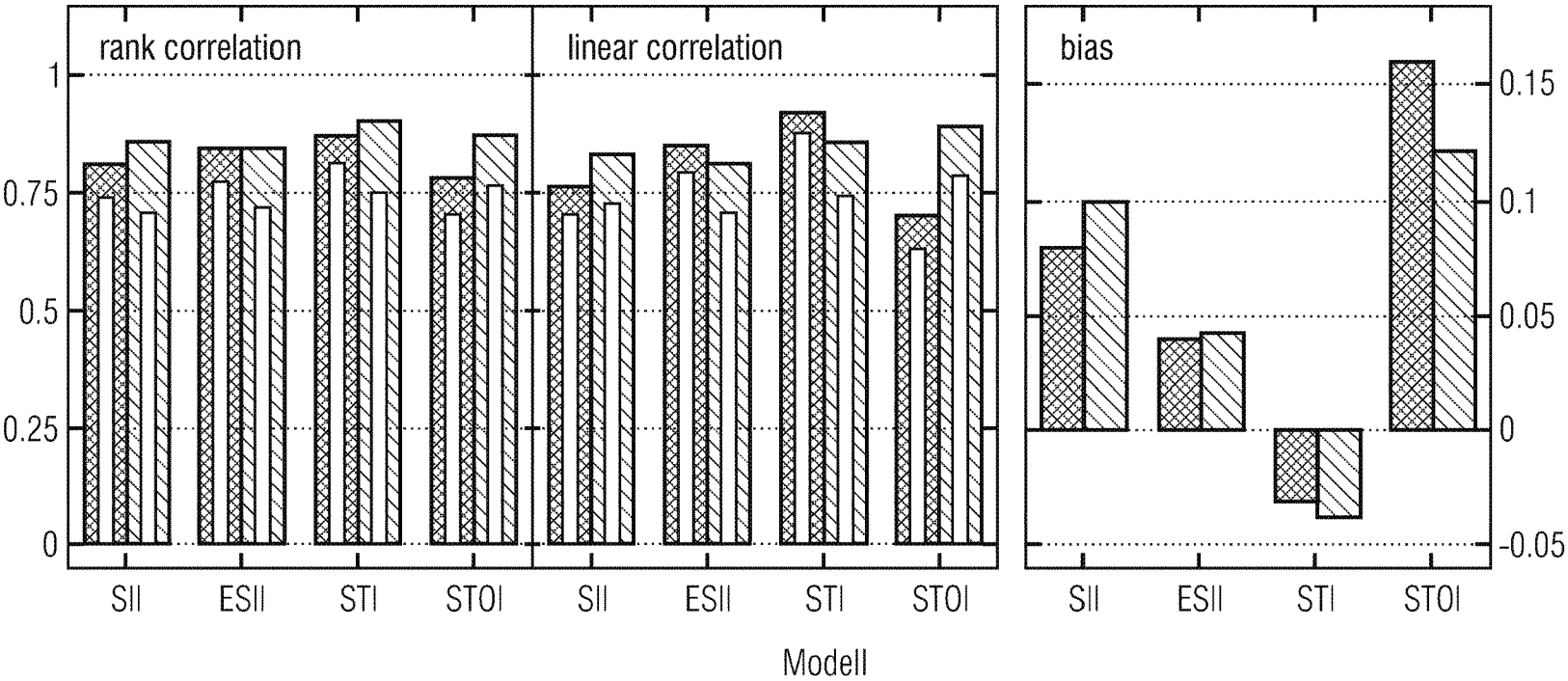
FIG. 9 illustrates correlation analyses regarding the subjective results.

FIG. 9 illustrates correlation analyses regarding the subjective results. With respect to prediction of Subjective Results, correlation analyses after non-linear transformation of model prediction values fitted from unprocessed reference condition in Car-noise and Cafeteria-noise.

$$P(SII)=\frac{m}{a+e^{-b\cdot SII}}+c.$$

From the subjective evaluation, it can be concluded that an increase in speech intelligibility is achieved by the pre-processing according to embodiments. The provided concepts according to embodiments show largest improvements in speech intelligibility. Moreover, current models for speech intelligibility show high rank-correlation with subjective data. Furthermore, predictions based on transformed model values show high linear correlations but partially exhibit large linear deviations.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1] ANSI (1997). Methods for calculation of the speech intelligibility index. *American National Standard ANSI S*3.5-1997 (American National Standards Institute, Inc.), New York, USA.

[2] Sauert, B. and Vary, P. (2010). Recursive closed-form optimization of spectral audio power allocation for near end listening enhancement. In *Proc. of ITG-Fachtagung Sprachkommunikation*. (Bochum, Germany, Oct. 6-8, 2010), volume 9.

[3] Sauert, B. and Vary, P. (2012). Near-end listening enhancement in the presence of bandpass noises. *In Proc. of ITG-Fachtagung Sprachkommunikation*. (Braunschweig, Germany, September 26-288, 2012).

[4] Vaidyanathan, P., Mitra, S., and Neuvo, Y. (1986). A new approach to the realization of low-sensitivity iir digital filters. *Acoustics, Speech and Signal Processing, IEEE Transactions on,* 34(2):350-361.

[5] Zorila, T.-C., Kandia, V., and Stylianou, Y. (2012a). Speech-in-noise intelligibility improvement based on power recovery and dynamic range compression. In 20*th European Signal Processing Conference* (EUSIPCO 2012), Bucharest Romania.

[6] Zorila, T.-C., Kandia, V., and Stylianou, Y. (2012b). Speech-in-noise intelligibility improvement based on spectral shaping and dynamic range compression. In *Proceedings of Interspeech* 2012 (Portland, USA).

The invention claimed is:

1. An apparatus for generating a modified audio speech signal from an audio speech input signal, wherein the audio speech input signal comprises a plurality of speech subband signals, wherein the modified speech signal comprises a plurality of modified subband signals, wherein the apparatus comprises:

a weighting information generator for generating weighting information for each speech subband signal of the plurality of speech subband signals depending on a signal power of said speech subband signal, and a signal modifier for modifying each speech subband signal of the plurality of speech subband signals by applying the weighting information of said speech subband signal on said speech subband signal to acquire a modified subband signal of the plurality of modified subband signals, wherein the apparatus is configured to output the modified audio speech signal, wherein the weighting information generator is configured to generate the weighting information for each of the plurality of speech subband signals and wherein the signal modifier is configured to modify each of the speech subband signals so that a first speech subband signal of the plurality of speech subband signals comprising a first signal power is amplified with a first degree, and so that a second speech subband signal of the plurality of speech subband signals comprising a second signal power is amplified with a second degree, wherein the first signal power is greater than the second signal power, and wherein the first degree is lower than the second degree, wherein the apparatus is implemented using a hardware apparatus or a computer or a combination of a hardware apparatus and a computer.

2. The apparatus according to claim 1, wherein a noise subband signal of a plurality of noise subband signals of a noise input signal is assigned to each speech subband signal of the plurality of speech subband signals, and wherein the weighting information generator is configured to generate the weighting information of each speech subband signal of the plurality of speech subband signals depending on a noise spectrum level of the noise subband signal of said speech subband signal, and wherein the weighting information generator is configured to generate the weighting information of each speech subband signal of the plurality of speech subband signals depending on a speech spectrum level of said speech subband signal.

3. The apparatus according to claim 2, wherein the weighting information generator is configured to generate the weighting information of each speech subband signal of the plurality of speech subband signals by determining a signal-to-noise ratio of said speech spectrum level of said speech subband signal and of said noise spectrum level of the noise subband signal of said speech subband signal.

4. The apparatus according to claim 3, wherein the signal-to-noise ratio $q(e_n, d_n)$ of said speech spectrum level of said speech subband signal and of said noise spectrum level of the noise subband signal of said speech subband signal is defined according to the formula $$q(e_n, d_n) = \begin{cases} 0 & \text{if } e_n \le d_n - 15\text{ dB} \\ \dfrac{e_n - d_n + 15\text{ dB}}{30\text{ dB}} & \text{if } d_n - 15\text{ dB} < e_n \le d_n + 15\text{ dB} \\ 1 & \text{if } e_n > d_n + 15\text{ dB} \end{cases}$$

wherein $e_n$ is said speech spectrum level of said speech subband signal, and wherein $d_n$ is said noise spectrum level of the noise subband signal of said speech subband signal.

5. The apparatus according to claim 3, wherein the weighting information generator is configured to generate the weighting information of the plurality of speech subband signals of the audio speech input signal by determining a speech intelligibility index and by determining for each speech subband signal of the plurality of speech subband signal a signal-to-noise ratio of the speech spectrum level of said speech subband signal and of said noise spectrum level of the noise subband signal of said speech subband signal, wherein the speech intelligibility index indicates a speech intelligibility of the audio speech input signal.

6. The apparatus according to claim 5, wherein the weighting information generator is configured to determine the speech intelligibility index $\tilde{S}II[l]$ according to the formula $$\tilde{SII}[l] = \sum_{n=1}^{N} i_n \cdot q(e_n[l], d_n[l]) \cdot \min\left\{1 - \frac{d_n[l] + 15\text{ dB} - u_n - 10\text{ dB}}{160\text{ dB}}, 1\right\},$$

wherein n indicates the n-th speech subband signal of the plurality of speech subband signals, wherein N indicates the total number of speech subband signals, wherein l indicates a block, wherein $q(e_n, d_n)$ indicates the signal-to-noise ratio of said speech spectrum level of the n-th speech subband signal and of said noise spectrum level of the noise subband signal of the n-th speech subband signal, wherein $u_n$ indicates a speech spectrum level being a fixed value, and wherein $i_n$ indicates a band importance.

7. The apparatus according to claim 5, wherein the weighting information generator is configured to generate the weighting information of each speech subband signal of the plurality of speech subband signals by determining a linear gain for each speech subband signal of the plurality of speech subband signals depending on the speech intelligibility index, depending on the signal power of said speech subband signal and depending on the sum of the signal powers of all speech subband signals of the plurality of speech subband signals.

8. The apparatus according to claim 7, wherein the weighting information generator is configured to generate a linear gain $w_{n,(lin)}$ for each speech subband signal of the plurality of speech subband signals according to the formula $$w_{n,(lin)}[l] = \sqrt{\frac{\phi_n^{\tilde{SII}}[l]}{\sum_{\lambda=1}^{N} \phi_\lambda^{\tilde{SII}}[l]} \cdot \frac{\phi_{(max)}[l]}{\phi_n[l]}}$$

wherein n indicates the n-th speech subband signal of the plurality of speech subband signals, wherein N indicates the total number of speech subband signals, wherein l indicates a block, wherein $\Phi_n$ [l] indicates the signal power of the n-th speech subband signal, and wherein $\Phi_{(max)}$ [l] is the sum of the signal powers of all speech subband signals of the plurality of speech subband signals.

9. The apparatus according to claim 3, wherein the weighting information generator is configured to determine a compression ratio $cr_n$ [l] according to the formula $$cr_n[l]=\max\{cr_{(max)}\cdot(1-q(e_n[l],d_n[l])),1\}.$$

wherein $q(e_n[l], d_n[l])$ is the signal-to-noise ratio of said speech spectrum level, wherein the signal-to-noise ratio $q(e_n[l], d_n[l])$ indicates a number between 0 and 1, wherein $cr_{(max)}$ indicates a fixed number, and wherein l indicates a block.

10. The apparatus according to claim 7, wherein the weighting information generator is configured to determine a compression ratio $cr_n$ [l] according to the formula $$cr_n[l]=\max\{cr_{(max)}\cdot(1-q(e_n[l],d_n[l])),1\}.$$

wherein $q(e_n[l], d_n[l])$ is the signal-to-noise ratio of said speech spectrum level, wherein the signal-to-noise ratio $q(e_n[l], d_n[l])$ indicates a number between 0 and 1, wherein $cr_{(max)}$ indicates a fixed number, and wherein l indicates a block.

11. The apparatus according to claim 9, wherein the weighting information generator is configured to generate the weighting information of each speech subband signal of the plurality of speech subband signals by determining a compressive gain $w_{n,(comp)}$ of said subband signal according to the formula $$w_{n,(comp)}[l \cdot M - m] = \sqrt{\left(\frac{\phi_n[l]}{\hat{s}_n^2[l \cdot M - m]}\right)^{\frac{(cr_n[l]-1)}{cr_n[l]}}},$$

$$m = 0, \ldots, M-1,$$

wherein M indicates a length of the block l, wherein $\Phi_n$ [l] indicates the signal power of said speech subband signal, and wherein $\hat{s}_n^2[l\cdot M-m]$ indicates a square of a smoothed estimate of an envelope of a speech signal amplitude of said speech subband signal.

12. The apparatus according to claim 11, wherein the weighting information generator is configured to determine the smoothed estimate $\hat{s}[k]$ of the envelope of the speech signal amplitude of said speech subband signal according to the formula $$\hat{s}_n[k] = \begin{cases} \hat{s}_n[k-1]\cdot\alpha_a + (1-\alpha_a)\cdot|s_n[k]| & \text{if } |s_n[k]| \geq \hat{s}_n[k-1] \\ \hat{s}_n[k-1]\cdot\alpha_r + (1-\alpha_r)\cdot|s_n[k]| & \text{if } |s_n[k]| < \hat{s}_n[k-1] \end{cases}$$

wherein $s_n$ [k] indicates said speech subband signal, wherein $|s_n[k]|$ indicates the amplitude of said speech subband signal, wherein $\alpha_a$ is a first smoothing constant and wherein $\alpha_r$ is a second smoothing constant.

13. The apparatus according to claim 1, wherein the weighting information generator is configured to generate the weighting information $\overline{w}_n$ of each speech subband signal of the plurality of speech subband signals by applying the formula $$\overline{w}_n[l\cdot M-m]=\alpha_p\overline{w}_n[l\cdot M-m-1]+(1-\alpha_p)p\ \overline{\lambda}_n[l](\hat{s}_n^2[l\cdot M-m])$$

wherein n indicates the n-th speech subband signal of the plurality of speech subband signals, wherein N indicates the total number of speech subband signals, wherein l indicates a block, wherein $\alpha_p$ is a smoothing constant, and wherein $\hat{s}_n^2[l\cdot M-M]$ indicates a square of a smoothed estimate of an envelope of a speech signal amplitude of said speech subband signal, wherein p $\overline{\lambda}_{n[l]}(\hat{s}_n^2[l\cdot M-m])$ indicates a function that performs linear interpolation and extrapolation of $\overline{\lambda}_n[l]$ wherein $\overline{\lambda}_n[l]$ indicates a smoothed input-output characteristic.

14. The apparatus according to claim 1, wherein the weighting information generator is configured to generate the weighting information for each of the plurality of speech subband signals and wherein the signal modifier is configured to modify each of the speech subband signals so that a first sum of all speech signal powers of all speech subband signals varies by less than 20% from a second sum of all speech signals powers of all modified subband signals.

15. The apparatus according to claim 2, wherein the weighting information generator is configured to generate the weighting information of each speech subband signal of the plurality of speech subband signals by determining a weighted addition, wherein the weighted addition depends on the noise spectrum level of the noise subband signal of said speech subband signal and depends on a reverberation spectrum level.

16. The apparatus according to claim 15, wherein the weighting information generator is configured to generate the reverberation spectrum level depending on a room impulse response between a loudspeaker and a microphone, depending on a reverberation time T60 or depending on a direct-to-reverberation energy ratio.

17. The apparatus according to claim 15, wherein the weighting information generator is configured to determine the weighted addition $a_n$ [l] according to the formula $$a_n[l]=\beta z_n[l]+d_n[l],$$

wherein $d_n$ [l] is said noise spectrum level of the noise subband signal of said speech subband signal, wherein $z_n$ [l] indicates said reverberation spectrum level, and wherein β is a real value.

18. The apparatus according to claim 1, wherein the apparatus further comprises a first filterbank and a second filterbank, wherein the first filterbank is configured to transform an unprocessed speech signal, being represented in a time domain, from the time domain to a subband domain to acquire the audio speech input signal comprising the plurality of speech subband signals, and wherein the second filterbank is configured to transform the modified audio speech signal, being represented in the subband domain and comprising the plurality of modified subband signals, from the subband domain to the time domain to acquire a time-domain output signal.

19. A method for generating a modified audio speech signal from an audio speech input signal, wherein the audio speech input signal comprises a plurality of speech subband signals, wherein the modified audio speech signal comprises a plurality of modified subband signals, wherein the method comprises:

generating weighting information for each speech subband signal of the plurality of speech subband signals depending on a signal power of said speech subband signal, modifying each speech subband signal of the plurality of speech subband signals by applying the weighting information of said speech subband signal on said speech subband signal to acquire a modified subband signal of the plurality of modified subband signals, and outputting the modified audio speech signal, wherein generating the weighting information for each of the plurality of speech subband signals and modifying each of the speech subband signals are conducted so that a first speech subband signal of the plurality of speech subband signals comprising a first signal power is amplified with a first degree, and so that a second speech subband signal of the plurality of speech subband signals comprising a second signal power is amplified with a second degree, wherein the first signal power is greater than the second signal power, and wherein the first degree is lower than the second degree, wherein the method is performed using a hardware apparatus or a computer or a combination of a hardware apparatus and a computer.

20. A non-transitory computer-readable medium comprising a computer program for implementing a method for generating a modified audio speech signal from an audio speech input signal, when being executed on a computer or signal processor, wherein the audio speech input signal comprises a plurality of speech subband signals, wherein the modified audio speech signal comprises a plurality of modified subband signals, wherein the method comprises:

generating weighting information for each speech subband signal of the plurality of speech subband signals depending on a signal power of said speech subband signal, modifying each speech subband signal of the plurality of speech subband signals by applying the weighting information of said speech subband signal on said speech subband signal to acquire a modified subband signal of the plurality of modified subband signals, and outputting the modified audio speech signal, wherein generating the weighting information for each of the plurality of speech subband signals and modifying each of the speech subband signals are conducted so that a first speech subband signal of the plurality of speech subband signals comprising a first signal power is amplified with a first degree, and so that a second speech subband signal of the plurality of speech subband signals comprising a second signal power is amplified with a second degree, wherein the first signal power is greater than the second signal power, and wherein the first degree is lower than the second degree.

* * * * *